United States Patent [19]

Gall

[11] 4,383,291

[45] May 10, 1983

[54] LAMP SHADE ASSEMBLY KIT

[75] Inventor: John C. Gall, Chicago, Ill.

[73] Assignee: Sears, Roebuck and Co., Chicago, Ill.

[21] Appl. No.: 237,024

[22] Filed: Feb. 23, 1981

[51] Int. Cl.[3] ..... F21V 1/06

[52] U.S. Cl. ..... 362/352; 362/356; 362/361; 362/434; 362/450

[58] Field of Search ..... 362/352, 356, 361, 434, 362/450

[56] References Cited

U.S. PATENT DOCUMENTS

| | | | |
|---|---|---|---|
| 2,819,386 | 1/1958 | Linderoth | 362/352 |
| 3,557,362 | 1/1971 | White et al. | 362/352 |
| 3,780,287 | 12/1973 | Fauri | 362/352 |
| 4,212,052 | 7/1980 | Chambard | 362/352 |
| 4,275,434 | 6/1981 | Borowitz | 362/352 |

*Primary Examiner*—Stephen J. Lechert, Jr.
*Attorney, Agent, or Firm*—Arnstein, Gluck & Lehr

[57] ABSTRACT

A lamp shade assembly kit includes an assembly ring formed of flexible material into a closed loop, a hoop formed of rigid material and a cover member formed of flexible material into a continuous, open-ended configuration. The assembly ring has an enlarged hoop-receiving channel opening inwardly about the periphery thereof. The cover member is adapted to be secured to the assembly ring. The hoop can then be inserted into the enlarged channel in the assembly ring to give a selected shape to the assembly ring and cover member. With these features, the lamp shade assembly kit may be shipped and stored in knockdown condition and quickly assembled without tools in any of a wide variety of shapes and sizes with optional decorative trim selections.

14 Claims, 9 Drawing Figures

LAMP SHADE ASSEMBLY KIT

FIELD OF THE INVENTION

The present invention relates to an improved lamp shade assembly kit. More particularly, the invention relates to a lamp shade assembly kit which includes an assembly ring having a hoop-receiving channel, a hoop, and a cover member wherein the hoop is adapted for insertion into the channel and the cover member is adapted to be secured to the assembly ring. The lamp shade assembly kit is adapted to be assembled after storage and shipment in knockdown form to provide a decorative lamp shade.

BACKGROUND OF THE INVENTION

Conventionally, lamp shades are manufactured in a formed or erected condition prior to being shipped. These lamp shades require considerable and inordinate amounts of storage and shipping space compared to the weight of the materials. While tapered or frusto-conical shades may be provided which can be nested or stacked, the nest or stack of shades still requires a large volume of space. These lamp shades may also have decorative covers with irregular surfaces such as trim strips at the upper and lower edges. When the lamp shades are packaged and shipped in a fully assembled condition, they can be damaged and the trim strips can be torn for a variety of reasons including damage to the box or container and tearing of the trim strips during separation of the nested shades.

Another consideration is that modern merchandising practices often require items, such as lamp shades, to be shipped and stored in individual packages for convenient delivery to a customer. This means that the economies that could otherwise be gained from nesting or stacking a number of lamp shades in a single carton are often not available notwithstanding the inherent problem of possible damage. Lamp shades which are preassembled or manufactured in erected condition simply cannot be economically and safely stored and shipped in individual containers.

Numerous attempts have been made to construct collapsible or knockdown lamp shades which can be stored and shipped compactly and later assembled by the consumer. However, these shades have often lacked aesthetic design features and have required additional difficult fabrication or assembly steps such as adhesively or mechanically applying trim strips and the like to the shade. For example, in U.S. Pat. No. 3,557,632, a lamp shade assembly is proposed which utilizes a preformed assembly ring to which lamp shade material is attached and to which decorative trimming also must be attached. Also, these shades have often utilized shade material and assembly rings which are totally devoid of any decorative treatment. Hence, it may be seen that in knockdown or collapsible lamp shades of the type previously proposed, additional operations or modifications would be required in order to apply decorative treatment.

Moreover, where the trim material is adhesively attached to a continuous plastic assembly strip, as in U.S. Pat. No. 3,557,362, the trim material can become detached due to stresses on the adhesive bonding. This may occur as a result of packaging and storing the strip in a relatively flat container. Further, it would be desirable in some instances to provide a knockdown lamp shade having a pleated shell which may be attached to an assembly ring to form a highly decorative, fashionable shade. This has not previously been contemplated in knockdown shades. Since lamp shade assembly kits, such as the one proposed in U.S. Pat. No. 3,780,287, make no provision for accommodating a pleated shell, such kits have lacked the versatility desired in a knockdown or collapsible lamp shade.

Finally, knockdown lamp shades that have been proposed have often required difficult assembly procedures. This is the case, for example, with the assembly proposed in U.S. Pat. No. 3,557,362, which utilizes a continuous assembly ring having a channel which is smaller in width at the entrance thereof than the thickness of the hoop to be inserted into the channel and which fails to provide any diametral clearance for insertion of the hoop into the channel. As a result, a need has remained for a decorative, easily assembled knockdown lamp shade assembly capable of use by the ordinary consumer.

Accordingly, it is an object of the present invention to provide a kit including an assembly ring, a hoop, and a cover member for assembling a decorative knockdown lamp shade which may be economically manufactured, and stored and shipped in a substantially flat container.

Another object of the present invention is the provision of a kit for assembling a lamp shade from parts without tools and with minimum effort and skill.

A further object of the present invention is the provision in a lamp shade kit of an assembly ring which is preformed to receive and retain a hoop and a flexible shade with an integral decorative pattern on its outer surface.

Another object of the present invention is the provision of a kit for assemblying a lamp shade having spaced apart outer surface identations on an assembly ring to receive adhesive by which a pleated shade covering may be attached to the ring.

A further object of the present invention is the provision in a lamp shade kit of an assembly ring having a channel with a mouth portion of equal or greater width than the thickness of a hoop to facilitate assembly.

Another object of the present invention is the provision of a kit for assemblying a lamp shade including an assembly ring having a channel with a recess of sufficient depth to provide clearance for convenient insertion of a hoop during assembly.

These and other objects, features and advantages of the present invention will become apparent from the following description when considered in connection with the accompanying drawings.

SUMMARY OF THE INVENTION

In general, the objects and advantages of the present invention are met by providing a kit for forming a lamp shade having an assembly ring formed of flexible material into a closed loop with a channel opening inwardly about the periphery thereof. A hoop is provided which is formed of rigid material for insertion into the channel in the assembly ring. The channel has a mouth portion equal to or greater in width than the thickness of the hoop and a recess of sufficient depth to provide clearance for the hoop so as to facilitate insertion of the hoop into the channel, and the hoop cooperates with the channel after insertion to give a selected shape to the assembly ring. A cover member is provided which is formed of flexible material into a continuous, open-ended configuration. The cover member has a dimension about the periphery of its upper edge substantially the same as the dimension about the periphery of the assembly ring to facilitate securing the cover member to the assembly ring. Additionally, means are provided for securing the hoop in the channel of the assembly ring and means are provided for securing the upper edge of the cover member to the assembly ring as well.

DETAILED DESCRIPTION OF THE PREFERRED EMBODIMENTS

Figure 1:
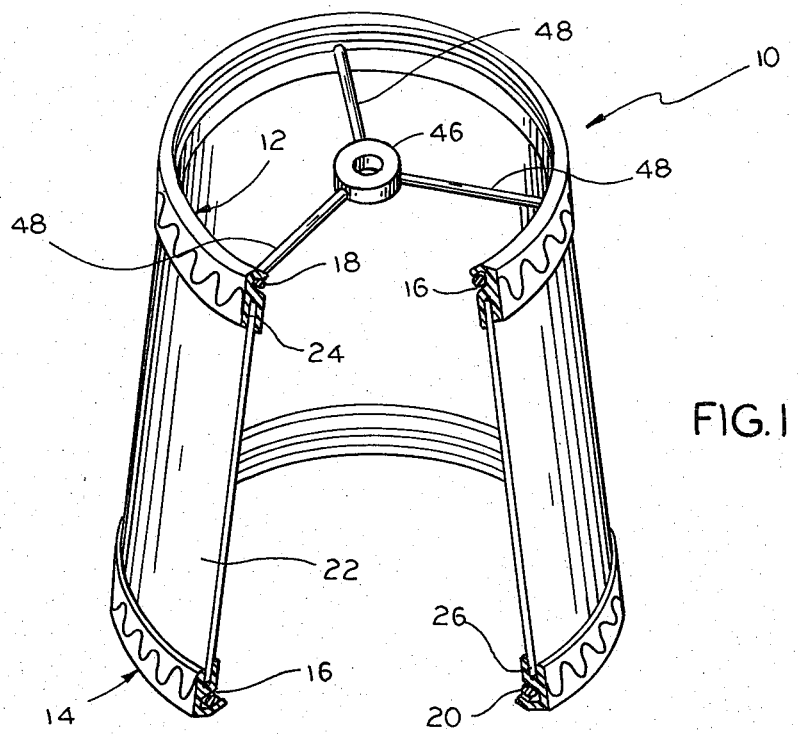
FIG. 1 is a perspective view, partially in cross section, of a lamp shade assembled from a kit in accordance with the present invention.

Referring to FIG. 1, the reference numeral 10 designates generally a lamp shade kit in accordance with the present invention. The kit 10 includes an upper assembly ring 12 and a lower assembly ring 14, each of which are substantially identically formed of flexible material into a closed loop having a channel 16 opening generally inwardly about the periphery thereof. A pair of hoops 18 and 20 are provided which are formed of rigid material for insertion into the channels 16 in the upper and lower assembly rings 12 and 14, respectively. The channels 16 have mouth portions 16*a* (see FIG. 9) equal to or greater in width than the thickness of the hoops 18 and 20 to facilitate insertion of the hoops into the channels, and the hoops 18 and 20 cooperate with the channels 16 after insertion to give a selected shape to the assembly rings 12 and 14. A cover member 22 is also provided which is formed of flexible material into a continuous, open-ended configuration having upper and lower edges 24 and 26, respectively. The cover member 22 has a dimension about the periphery of the upper edge 24 substantially the same as the dimension about the periphery of the upper assembly ring 12 and has a dimension about the periphery of the lower edge 26 substantially the same as the dimension about the periphery of the lower assembly ring 14 to facilitate securing the cover member to the assembly rings. Additionally, means are provided for securing the hoops 18 and 20 in the channels 16 of the assembly rings 12 and 14, respectively, and means are provided for securing the upper edge 24 of the cover member 22 to the upper assembly ring 12 and the lower edge 26 of the cover member 22 to the lower assembly ring 14, as will be described more fully hereinafter.

Figure 2:
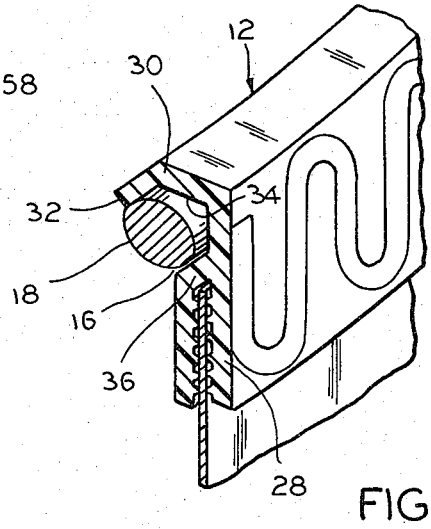
FIG. 2 is a fragmentary perspective view, on an enlarged scale and partially in cross section, of a structural detail of the lamp shade of FIG. 1.

Referring to FIG. 2, an enlarged view of a portion of the upper assembly ring 12 is shown for purposes of better illustrating the structural details. The assembly ring 12 comprises a body portion generally L-shaped in cross section having integral vertical and lateral legs 28 and 30, respectively. The lateral leg 30 is directed generally inwardly about the periphery of the assembly ring 12 and the channel 16 is formed in the lateral leg 30 so as to open inwardly and downwardly of the assembly ring 12. The channel 16 is partially defined by a lip portion 32 extending inwardly of the vertical leg 28. The lip portion 32 is disposed at an acute angle to the vertical leg 28 and serves to center and retain the hoop 18 within the channel 16 during and after insertion thereof. The channel 16 is also partially defined by a tapered recess 34 into which the mouth portion 16*a* leads. The tapered recess 34 has a depth sufficient to accommodate reasonable tolerances in the dimensions of the hoop 18 and the assembly ring 12 and to provide clearance for insertion of the hoop 18 into the channel 16 of the assembly ring 12. The channel 16 is further partially defined by a ramp portion 36 spaced from and generally parallel to the lip portion 32. The ramp portion 36 and the lip portion 32 comprise opposed surface portions of the channel 16 which are spaced apart from one another by a distance greater than the thickness of the hoop 18 and lead into the tapered recess 34. Except for possible differences in diametrical sizes, the upper and lower assembly rings 12 and 14, respectively, are preferably identical in cross-sectional configuration but, as will be noted, are oppositely arranged in assembly as shown in FIGS. 1 and 8.

Referring specifically to the tapered recess 34 illustrated in FIGS. 1 and 2, it will be appreciated that it is oversized so as to be greater in diameter than the hoop 18. This provides needed diametral clearance so that the hoop 18 can be positioned deep within the tapered recess 34 on one side of the assembly ring 12 while the hoop is circumferentially worked into the channel toward the other side of the assembly ring. By simultaneously working the hoop 18 into the channel 16 from opposite directions, the diametral clearance will permit the hoop 18 to be easily inserted into the channel 16 at the other side of the assembly ring 12.

Once the hoop 18 is fully inserted into the channel 16 as described, the hoop will automatically assume a centered position. This will occur, as previously mentioned, by reason of the oversized or enlarged channel 16 and, specifically, because of the enlarged mouth portion 16*a*, the oversized tapered recess 34 and the lip portion 32. As will be appreciated, the hoop 18 is free to move within the channel 16 after insertion whereby the resumption of the angular orientation of the components defining the channel 16 bring about the desired centering of the hoop.

Figure 8:
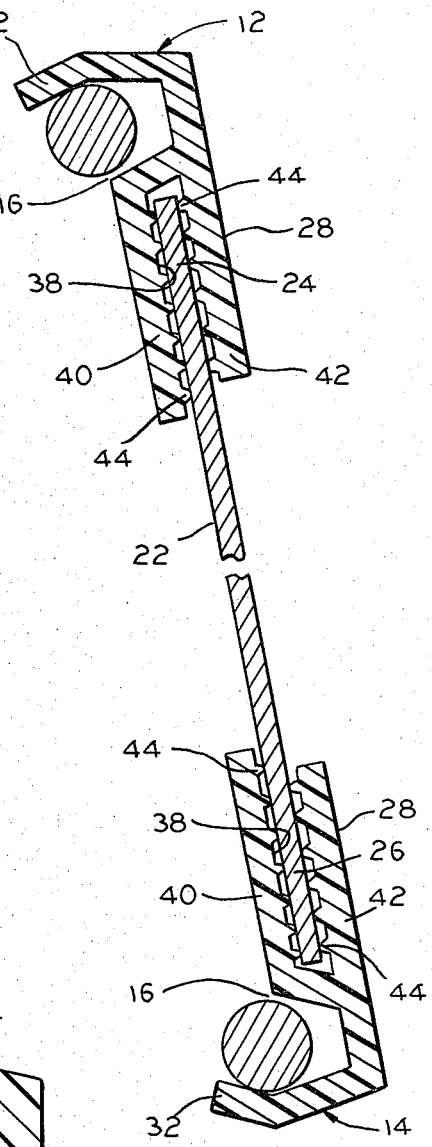
FIG. 8 is a cross-sectional view, on an enlarged scale and partially broken away, of the lamp shade of FIG. 1.

As will be seen from FIG. 8, the channel 16 in the upper assembly ring 12 opens inwardly and downwardly and the channel 16 in the lower assembly ring 14 opens inwardly and upwardly. The lip portions 32 of the assembly rings comprise means for securing the hoops 18 and 20 in the channels 16 and, as previously mentioned, they are disposed at an acute angle to their vertical legs 28 with the angle and relative dimensional relationships being chosen in order to secure the hoops 18 and 20 out of the line of sight when the lamp shade is assembled for use. The assembly rings 12 and 14 also include narrow slots 38 in their vertical legs 28 which are adapted to receive and retain the edges 24 and 26 of the cover member 22. The slots 38 are each defined by a pair of generally parallel wall portions 40 and 42 wherein at least one, and preferably both, of the wall portions have a plurality of ribs 44 thereabout projecting inwardly of the slot to horizontally disperse an adhesive (not shown) for securing one of the edges of the cover member 22. As will be appreciated, the slot 38 in the upper assembly ring 12 opens downwardly to receive and retain the upper edge 24 of the cover member 22 and the slot 38 in the lower assembly ring 14 opens inwardly to receive and retain the lower edge 26 of the cover member 22 to form the lamp shade.

In a preferred embodiment, the assembly rings 12 and 14 are formed of strips of extruded flexible material of a selected length with the end edges secured in abutting relationship to form a closed loop configuration. The cover member 22 is also preferably formed of a strip of flexible material of a selected length with the longitudinal edges secured in fixed relationship to form the continuous, open-ended configuration conventionally utilized in lamp shades. Additionally, the hoops 18 and 20 are preferably continuous, generally circular members dimensiond to fit within the channels 16 of the assembly rings 12 and 14 to support the assembly rings and the cover member 22 in shape retaining fashion.

Figure 5:
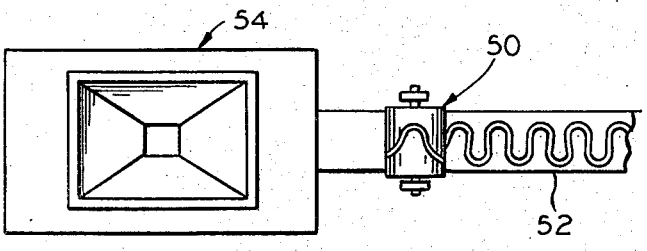
FIG. 5 is a fragmentary diagramatic plan view of an apparatus for applying a decoration to the assembly ring in accordance with the present invention.
Figure 6:
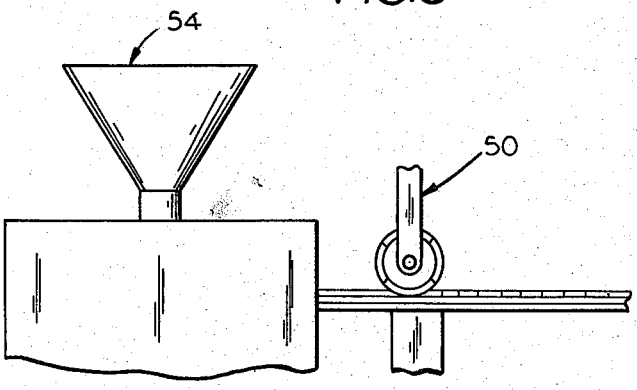
FIG. 6 is a side elevational view of the apparatus illustrated in FIG. 5.

Referring again to FIG. 1, the upper hoop 18 preferably includes a hub 46 connected to a series of radiating spokes 48. The hub 46 is, of course, adapted for supporting the fully assembled lamp shade upon a lamp in conventional fashion. Other features of the lamp shade kit illustrated in FIG. 1 include providing the outwardly facing surfaces of the assembly rings 12 and 14 with an ornamental design. The ornamental design may be applied by any conventional means. As shown in FIGS. 5 and 6, for example, a roller-applicator 50 may be utilized to apply a serpentine configuration 52 shortly after the extruded assembly ring exits from the extruding apparatus 54.

With the roller-applicator 50, it will be understood that any desirable ornamental pattern may be applied to the extrusion strip. For example, while not illustrated, it is contemplated that contrasting or complemental colors may be applied to the extrusion strip in a variety of patterns and the like. Among the conventional methods of application that may be utilized are decorative applique, hot press and other similar techniques.

Figure 3:
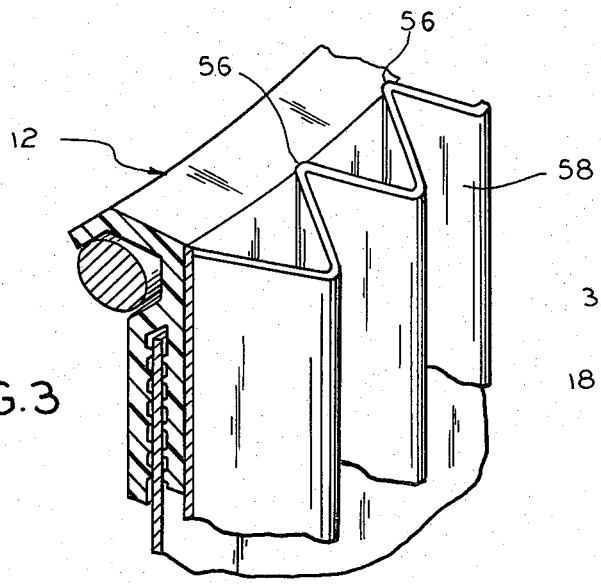
FIG. 3 is a view similar to FIG. 2 but showing a modified embodiment with a pleated shell in accordance with the present invention.
Figure 7:
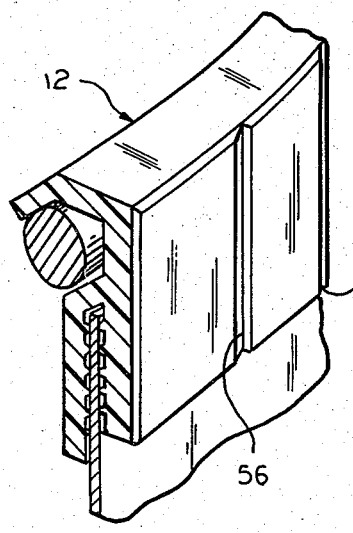
FIG. 7 is a view similar to FIG. 3 showing the assembly ring of the modified embodiment before attachment of the pleated shell.

In a modified embodiment illustrated in FIGS. 3 and 7, the assembly ring 12 is formed of an extrusion in a similar fashion as in the first described embodiment. However, the assembly rings are provided with a series of equally spaced vertical grooves 56 instead of bearing an ornamental pattern. It will be appreciated by those skilled in the art that the grooves may be formed in the extrusion strip during or after the extrusion process in accordance with conventional techniques. The grooves 56 of the upper and lower assembly rings can be aligned in vertical registration to afford means for facilitating the attachment of a pleated outer cover member 58. A suitable adhesive is deposited in the grooves 56 and the outer cover member 58 is caused to be adhered to the assembly rings by pressing the inner folds of the outer cover member into the grooves 56 in the manner illustrated in FIG. 3.

Figure 9:
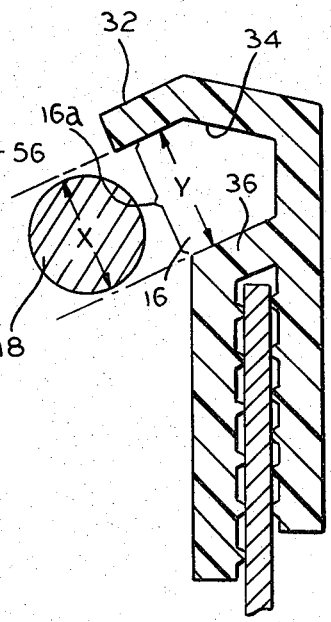
FIG. 9 is a cross-sectional view, on an enlarged scale, of a structural detail showing the hoop prior to insertion into the assembly ring together with the dimensional relationships thereof.

Referring to FIG. 9, the dimensional relationships of the channel and the hoop are illustrated. The hoop 18, shown immediately prior to insertion into the channel 16, has a thickness or diameter dimension, "X", which is equal to or less than the width of the mouth portion of the channel 16, "Y", defined by the distance between the parallel lip and ramp portions 32 and 36, respectively. Since the hoop 18 is smaller than the mouth portion leading into the channel 16, the hoop may easily be inserted into the channel 16 without the use of tools or excess force by the ultimate consumer.

The cover member may be formed from a single sheet of a variety of flexible materials such as oiled paper stock or plastic sheeting with overlapped cemented edges as is well known in the art. Moreover, the shape of a fully assembled lamp shade utilizing the kit of the present invention may be frusto-conical, cylindrical, or any other suitable configuration utilizing the teachings of the present invention in contrast to the frusto-conical configurations which, alone, were preferred in factory assembled lamp shades because the finished lamp shades could then be nested for shipping. Additionally, the assembly rings may be formed of any suitable extruded plastic composition having the desired characteristics of flexibility and resilience.

As will be appreciated, the assembly rings 12 and 14 are extruded in the form of a continuous strip which is then cut into sections of appropriate lengths. The end edges of the cut sections are then secured in abutting relation by adhesive bonding or heat welding depending upon the material utilized. It will be noted, in the case of a frusto-conical shade, that the length of the section intended for the upper assembly ring 12 will be shorter than that for the lower assembly ring 14. The upper and lower assembly rings are also differently oriented for a frusto-conical shade. As shown in FIG. 8, the respective slots 38 must be properly angularly aligned to receive the upper and lower edges of the cover member 22.

Preferably, the cover member 22 is assembled with the upper and lower assembly rings 12 and 14, respectively, at the factory. This is accomplished by inserting the upper and lower marginal edge portions 24 and 26 of the cover member 22 into the respective slots 38. When this has been done, a suitable adhesive is utilized to bond the cover member 22 within the slots 38 in the assembly rings 12 and 14.

Figure 4:
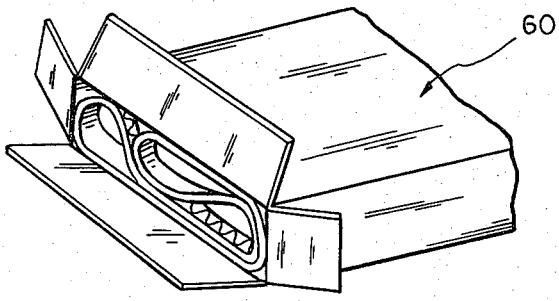
FIG. 4 is a fragmentary perspective view showing a portion of the lamp shade kit packaged for shipment.

Referring to FIG. 4, the components of the lamp shade are intended to be packaged in knockdown condition as a kit for shipment and storage in a generally flat container 60 which is, of course, of adequate size to accommodate the upper and lower hoops 18 and 20. While the container 60 can be made large enough to accommodate the assembly rings without folding, the height of the container should be of such size as to permit folding of the assembly rings and cover member without permanently creasing the cover member in the event that it is desired to ship the components in this fashion.

When the container 60 is received, the customer can easily complete assembly of the shade by inserting the upper and lower hoops 18 and 20, respectively, into the mouth portions **16*a* of the channels 16 in the upper and lower assembly rings 12 and 14, respectively. The enlarged mouth portions 16*a* of the channels 16 defined by the parallel lip and ramp portions 32 and 36**, respectively, facilitate insertion of the hoops into the channels, and the lip portions, cooperating with the ramp portions, serve to retain the hoops within the channels in shape retaining fashion. When the hoops have been inserted into the channels, the shade is fully assembled and will remain in such condition unless disassembled in a reverse manner for storage and shipment.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A kit for forming a lamp shade, comprising:

an upper assembly ring and a lower assembly ring, said assembly rings each being substantially identically formed of flexible material into a closed loop having a channel opening generally inwardly about the periphery thereof, said channels each being defined by a lip portion spaced from and generally parallel to a ramp portion thereof;

a pair of hoops formed of rigid material for insertion into said channels in said upper and lower assembly rings, said hoops cooperating with said channels after insertion to give a selected shape to said assembly rings, said channels having oversized diametral recesses to facilitate insertion of said hoops into said channels, said lip and ramp portions of said channels being spaced apart from one another by a distance equal to or greater than the thickness of said hoops;

a cover member formed of flexible material into a continuous, open-ended configuration having upper and lower edges, said cover member having a dimension about the periphery of said upper edge substantially the same as the dimension about the periphery of said upper assembly ring, said cover member having a dimension about the periphery of said lower edge substantially the same as the dimension about the periphery of said assembly ring; and means for securing said upper edge of said cover member to said upper assembly ring and said lower edge of said cover member to said lower assembly ring.

2. The kit as defined by claim 1 wherein said lip portions of said channels are adapted to retain said hoops in said channels.

3. The kit as defined in claim 1 wherein said channel in said upper assembly ring opens inwardly and downwardly and said channel in said lower assembly ring opens inwardly and upwardly, said lip portions of said channels securing said hoops out of the line of sight.

4. The kit as defined by claim 1 wherein said upper assembly ring includes a narrow downwardly opening slot adapted to receive and retain said upper edge of said cover member and said lower assembly ring includes a narrow upwardly opening slot adapted to receive and retain said lower edge of said cover member to form a lamp shade.

5. The kit as defined by claim 4 wherein said slots are each defined by a pair of generally parallel wall portions, at least one of said wall portions of each of said slots having a plurality of ribs thereabout projecting inwardly of said slot for dispersing an adhesive, said ribs and said adhesive comprising said means for securing said edges of said cover member to said assembly rings.

6. The kit as defined by claim 1 wherein said hoops are continuous, generally circular members adapted for insertion into said channels, said selected shape of said assembly rings being generally circular after insertion of said hoops.

7. The kit as defined by claim 6 wherein said hoops are dimensioned to fit within said channels of said assembly rings to support said assembly rings and said cover member in shape retaining fashion.

8. The kit as defined by claim 7 wherein at least one of said hoops includes a hub connected to a series of spokes in radiating fashion, said hoop having said hub being adapted for insertion into said channel of said upper assembly ring, said hub being adapted to support said lamp shade after assembly thereof upon a lamp.

9. The kit as defined by claim 1 wherein said assembly rings each include a plurality of vertically extending grooves therein, said grooves of both said upper and lower assembly rings being alignable in vertical registration, said cover member being pleated for securing the inner folds of the pleats in said grooves with an adhesive, said adhesive, grooves, and inner folds comprising said means for securing said cover member to said assembly rings.

10. The kit as defined by claim 1 wherein said assembly rings include outwardly facing surfaces having an ornamental design thereon.

11. A kit for forming a lamp shade, comprising:

an assembly ring formed of flexible material into a closed loop having a channel opening generally inwardly about the periphery thereof, said channel being defined by a lip portion spaced from and generally parallel to a ramp portion thereof;

a hoop formed of rigid material for insertion into said channel in said assembly ring, said hoop cooperating with said channel after insertion to give a selected shape to said assembly ring, said channel having an oversized diametral recess to facilitate insertion of said hoop into said channel, said lip and ramp portions of said channel being spaced apart from one another by a distance equal to or greater than the thickness of said hoop;

a cover member formed of flexible material into a continuous, open-ended configuration having upper and lower edges, said cover member having a dimension about the periphery of said upper edge substantially the same as the dimension about the periphery of said assembly ring; and means for securing said upper edge of said cover member to said assembly ring.

12. The kit as defined by claim 11 wherein said assembly ring includes a body portion generally L-shaped in cross-section and having integral vertical and lateral legs.

13. The kit as defined by claim 12 wherein said lateral leg is directed generally inwardly about the periphery of said assembly ring and said channel is formed in said lateral leg so as to open inwardly and downwardly of said assembly ring.

14. The kit as defined by claim 13 wherein said lip portion extends inwardly of said vertical leg, said lip portion being disposed at an acute angle to said vertical leg, said lip portion serving to center and retain said hoop within said channel during and after insertion thereof.

* * * * *